US011143173B2

(12) United States Patent
Howseman, Jr.

(10) Patent No.: US 11,143,173 B2
(45) Date of Patent: Oct. 12, 2021

(54) HYDRAULICALLY SYNCHRONIZED PUMPS WHERE THE HYDRAULIC MOTOR OF THE MASTER PUMP HYDRAULICALLY DRIVES THE HYDRAULIC MOTOR OF THE SLAVE PUMP

(71) Applicant: William E. Howseman, Jr., Camarillo, CA (US)

(72) Inventor: William E. Howseman, Jr., Camarillo, CA (US)

( * ) Notice: Subject to any disclaimer, the term of this patent is extended or adjusted under 35 U.S.C. 154(b) by 248 days.

(21) Appl. No.: 15/876,131

(22) Filed: Jan. 20, 2018

(65) Prior Publication Data

US 2019/0226465 A1 Jul. 25, 2019

(51) Int. Cl.

| | |
|---|---|
| ***F04B 9/109*** | (2006.01) |
| ***F04B 13/02*** | (2006.01) |
| ***F04B 53/10*** | (2006.01) |
| ***F15B 1/26*** | (2006.01) |
| ***F04B 23/06*** | (2006.01) |
| ***F04B 9/105*** | (2006.01) |
| ***F04B 49/22*** | (2006.01) |
| *F04B 15/00* | (2006.01) |

(52) U.S. Cl.

CPC ..... *F04B 9/109* (2013.01); *F04B 9/105* (2013.01); *F04B 13/02* (2013.01); *F04B 23/06* (2013.01); *F04B 49/22* (2013.01); *F04B 53/10* (2013.01); *F15B 1/26* (2013.01); *F04B 15/00* (2013.01)

(58) Field of Classification Search

CPC ..... F04B 9/103; F04B 9/1035; F04B 9/1053; F04B 9/1056; F04B 9/109; F04B 9/105; F04B 49/22; F04B 23/06; F04B 53/10; F04B 13/02; F04B 15/00; F15B 1/26

See application file for complete search history.

(56) References Cited

U.S. PATENT DOCUMENTS

| | | | | |
|---|---|---|---|---|
| 2,771,958 | A | 11/1956 | Ball | |
| 2,887,060 | A | 5/1959 | Adams et al. | |
| 3,039,266 | A | 6/1962 | Schenkelberger | |
| 3,097,764 | A | 7/1963 | Loeser | |
| 3,179,120 | A | 4/1965 | Erickson et al. | |
| 3,752,039 | A * | 8/1973 | Hewins | F15B 7/10 91/171 |

(Continued)

FOREIGN PATENT DOCUMENTS

| | | |
|---|---|---|
| CN | 106050595 | 10/2016 |

OTHER PUBLICATIONS

"Pneumatics vs Hydraulics", http://www.engineerstudent.co.uk/pneumatics_vs_hydraulics.shtm (Year: 2013).*

*Primary Examiner* — Essama Omgba
*Assistant Examiner* — Christopher J Brunjes
(74) *Attorney, Agent, or Firm* — Law Offices of Steven W. Weinrieb

(57) ABSTRACT

A system of pumps wherein a first hydraulic motor operatively connected to a first master pump can hydraulically drive a second hydraulic motor operatively connected to a second slave pump. A hydraulic fluid outlet of the first hydraulic motor is fluidically connected to a hydraulic fluid inlet of the second hydraulic motor whereby the first hydraulic motor, operatively connected to the first pump, drives the second hydraulic motor, operatively connected to the second pump, in a hydraulically synchronized manner.

6 Claims, 3 Drawing Sheets

(56) References Cited

U.S. PATENT DOCUMENTS

| | | | | |
|---|---|---|---|---|
| 4,312,463 | A * | 1/1982 | Daby | B01F 15/0462 222/134 |
| 4,328,824 | A | 5/1982 | Kiernan et al. | |
| 4,490,096 | A | 12/1984 | Box | |
| 4,522,789 | A | 6/1985 | Kelly et al. | |
| 4,809,909 | A | 3/1989 | Kukush | |
| 5,114,319 | A | 5/1992 | Faber | |
| 5,294,052 | A | 3/1994 | Kukesh | |
| 5,306,124 | A | 4/1994 | Back | |
| 6,105,880 | A | 8/2000 | Bazil et al. | |
| 6,666,385 | B1 | 12/2003 | Gonitzke et al. | |
| D771,719 | S | 11/2016 | Van Keulen et al. | |
| D774,116 | S | 12/2016 | Norman et al. | |
| 2004/0057853 | A1 | 3/2004 | Ross et al. | |
| 2004/0136832 | A1* | 7/2004 | Hammonds | F04B 9/02 417/43 |
| 2009/0220358 | A1* | 9/2009 | Krivsky | F04B 9/1095 417/254 |
| 2013/0064696 | A1 | 3/2013 | McCormick et al. | |
| 2015/0361968 | A1* | 12/2015 | Schroeder | F04B 13/02 417/53 |
| 2016/0245399 | A1* | 8/2016 | Watanabe | F16H 61/0267 |
| 2016/0346801 | A1 | 12/2016 | Brudevold et al. | |

* cited by examiner

HYDRAULICALLY SYNCHRONIZED PUMPS WHERE THE HYDRAULIC MOTOR OF THE MASTER PUMP HYDRAULICALLY DRIVES THE HYDRAULIC MOTOR OF THE SLAVE PUMP

FIELD OF THE INVENTION

The present invention relates generally to pumps, and more particularly to a system of pumps wherein a first hydraulic motor operatively connected to a first master pump can hydraulically drive a second hydraulic motor operatively connected to a second slave pump.

BACKGROUND OF THE INVENTION

Pumps are of course well known and there are also of course a multitude of different types of pumps. Examples of different types of pumps may be, for example, gear pumps, slurry pumps, metering pumps, variable volume pumps, diaphragm pumps, master pumps, slave pumps, catalyst pumps, resin pumps, piston pumps, reciprocating pumps, displacement pumps, and the like. Various different types of pumps are disclosed, for example, within U.S. Pat. No. 6,666,385 which issued to Gonitzke et al. on Dec. 23, 2003; U.S. Pat. No. 6,105,880 which issued to Bazil et al. on Aug. 22, 2000; U.S. Pat. No. 5,306,124 which issued to Back on Apr. 26, 1994; U.S. Pat. No. 5,294,052 which issued to Kukesh on Mar. 15, 1994; U.S. Pat. No. 5,114,319 which issued to Faber on May 19, 1992; U.S. Pat. No. 4,809,909 which issued to Kukesh on Mar. 7, 1989; U.S. Pat. No. 4,522,789 which issued to Kelly et al. on Jun. 11, 1985; U.S. Pat. No. 4,490,096 which issued to Box on Dec. 25, 1984; U.S. Pat. No. 4,328,824 which issued to Kiernan et al. on May 11, 1982; U.S. Pat. No. 3,179,120 which issued to Erickson et al. on Apr. 20, 1965; U.S. Pat. No. 3,097,764 which issued to Loeser on Jul. 16, 1963; U.S. Pat. No. 3,039,266 which issued to Schenkelberger on Jun. 19, 1962; U.S. Pat. No. 2,887,060 which issued to Adams et al. on May 19, 1959; U.S. Pat. No. 2,771,958 which issued to Ball on Nov. 27, 1956; United States Patent Application Publication 2016/0346801 of Brudevold et al. which was published on Dec. 1, 2016; United States Patent Application Publication 2015/0361968 of Schroeder et al. which was published on Dec. 17, 2015; United States Patent Application Publication 2013/0064696 of McCormick et al. which was published on Mar. 14, 2013; United States Patent Application Publication 2004/0057853 of Ross et al. which was published on Mar. 25, 2004; U.S. Design Pat. No. D-774,116 which was issued to Norman et al. on Dec. 13, 2016; U.S. Design Pat. No. D-771,719 which issued to Van Keulen et al. on Nov. 16, 2016; and Chinese Patent 106050595 which issued on Oct. 26, 2016.

As can be readily appreciated from the aforenoted prior art, many multi-pump systems are relatively complex. Such systems may employ, for example, hydraulic control circuits which include hydraulic fluid proportioners or dividers. Other systems may comprise mechanical connections, such as, for example, what is known in the art as a drive bar, which projects outwardly from the master pump and is connected to or engaged with the slave pump so as to ensure that the two pumps are operated in a synchronous mode, however, such systems do not handle divergent viscosity characteristics of the two different materials being pumped by the master and slave pumps, or desirably consistent output ratios between the two components being pumped.

A need therefore exists in the art for a new and improved multi-pump system. An additional need exists in the art for a new and improved multi-pump system wherein the system comprises two pumps. A further need exists in the art for a new and improved multi-pump system wherein the two pumps comprise a master pump and a slave pump. A still further need exists in the art for a new and improved multi-pump system wherein the master and slave pumps can be operated synchronously. A yet further need exists in the art for a new and improved multi-pump system wherein the two master and slave double-acting two-valve pumps can be hydraulically synchronized so as to eliminate conventional mechanical connections between conventional master and slave pump systems. A still yet further need exists in the art for a new and improved multi-pump system wherein the two master and slave double-acting two-valve pumps can be hydraulically synchronized so as to effectively improve the operational efficiency of the multi-pump system. A yet still further need exists in the art for a new and improved multi-pump system wherein the two master and slave double-acting two-valve pumps can be hydraulically synchronized so as to effectively improve the operational efficiency of the multi-pump system without regard to the particular viscosity characteristics of the fluids being pumped. An additional need exists in the art for a new and improved multi-pump system wherein the two master and slave double-acting two-valve pumps can be hydraulically synchronized so as to effectively improve the operational efficiency of the multi-pump system without regard to the mass flow rates of the two fluids being pumped.

OVERALL OBJECTIVES OF THE PRESENT INVENTION

Accordingly, an overall objective of the present invention is to provide a new and improved multi-pump system. An additional overall objective of the present invention is to provide a new and improved multi-pump system wherein the system comprises two pumps. A further overall objective of the present invention is to provide a new and improved multi-pump system wherein the two pumps comprise a master pump and a slave pump. A still further overall objective of the present invention is to provide new and improved multi-pump system wherein the master and slave pumps can be operated synchronously. A yet further overall objective of the present invention is to provide a new and improved multi-pump system wherein the two master and slave double-acting two-valve pumps can be hydraulically synchronized so as to eliminate conventional mechanical connections between conventional master and slave pump systems. A still yet further overall objective of the present invention is to provide a new and improved multi-pump system wherein the two master and slave double-acting two-valve pumps can be hydraulically synchronized so as to effectively improve the operational efficiency of the multi-pump system. A yet still further overall objective of the present invention is to provide a new and improved multi-pump system wherein the two master and slave double-acting two-valve pumps can be hydraulically synchronized so as to effectively improve the operational efficiency of the multi-pump system without regard to the particular viscosity characteristics of the fluids being pumped. An additional overall objective of the present invention is to provide a new and improved multi-pump system wherein the two master and slave double-acting two-valve pumps can be hydraulically synchronized so as to effectively improve the operational efficiency of the multi-pump system.

SUMMARY OF THE INVENTION

The foregoing and other objectives are achieved in accordance with the teachings and principles of the present invention through the provision of a new and improved multi-pump system wherein each one of the pumps comprises a double-acting two-valve pump. A first one of the pumps is to be considered the master pump and will output a first fluid, such as, for example, a catalyst, while the second one of the pumps is to be considered the slave pump and will output a second fluid, such as, for example, a resin. In accordance with the particularly unique principles and teachings of the present invention, both pumps are respectively driven by first and second hydraulic motors which are fluidically connected to a closed hydraulic circuit. A two-position four-way valve is included within the hydraulic circuit such that incoming hydraulic fluid is initially conducted to a first lower inlet port of the first hydraulic motor wherein a first motor piston of the first hydraulic motor, which is operatively connected to a first pump piston of the first master pump, moves upwardly so as to actuate the first pump piston of the first master pump such that the first master pump can output its fluid during the upstroke of the first pump piston. At the same time, the first upper outlet port of the first hydraulic motor is fluidically connected, through means of the two-position, four-way valve, to a hydraulic inlet conduit of the second hydraulic motor operatively associated with the second slave pump. Upon reaching its end-of-stroke position upon completion of its upward movement, the first motor piston of the first hydraulic motor will generate a signal which causes the two-position, four-way valve to switch its positions such that incoming hydraulic fluid is now conducted to the upper outlet port of the first hydraulic motor so as to drive the first motor piston of the first hydraulic motor downwardly, while the first lower inlet port of the first hydraulic motor is now fludicially connected to the hydraulic inlet conduit of the second hydraulic motor. When the first motor piston of the first hydraulic motor reaches its end-of-stroke position upon completion of its downward movement, it will again cause a signal to be generated such that the two-position, four-way valve will be switched back to its original position. The second hydraulic motor is also provided with a hydraulic fluid outlet which is fluidically connected to a hydraulic fluid supply tank from which hydraulic fluid is conducted back to the first lower inlet port of the first hydraulic motor by means of an auxiliary pump and the two-position, four-way valve.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
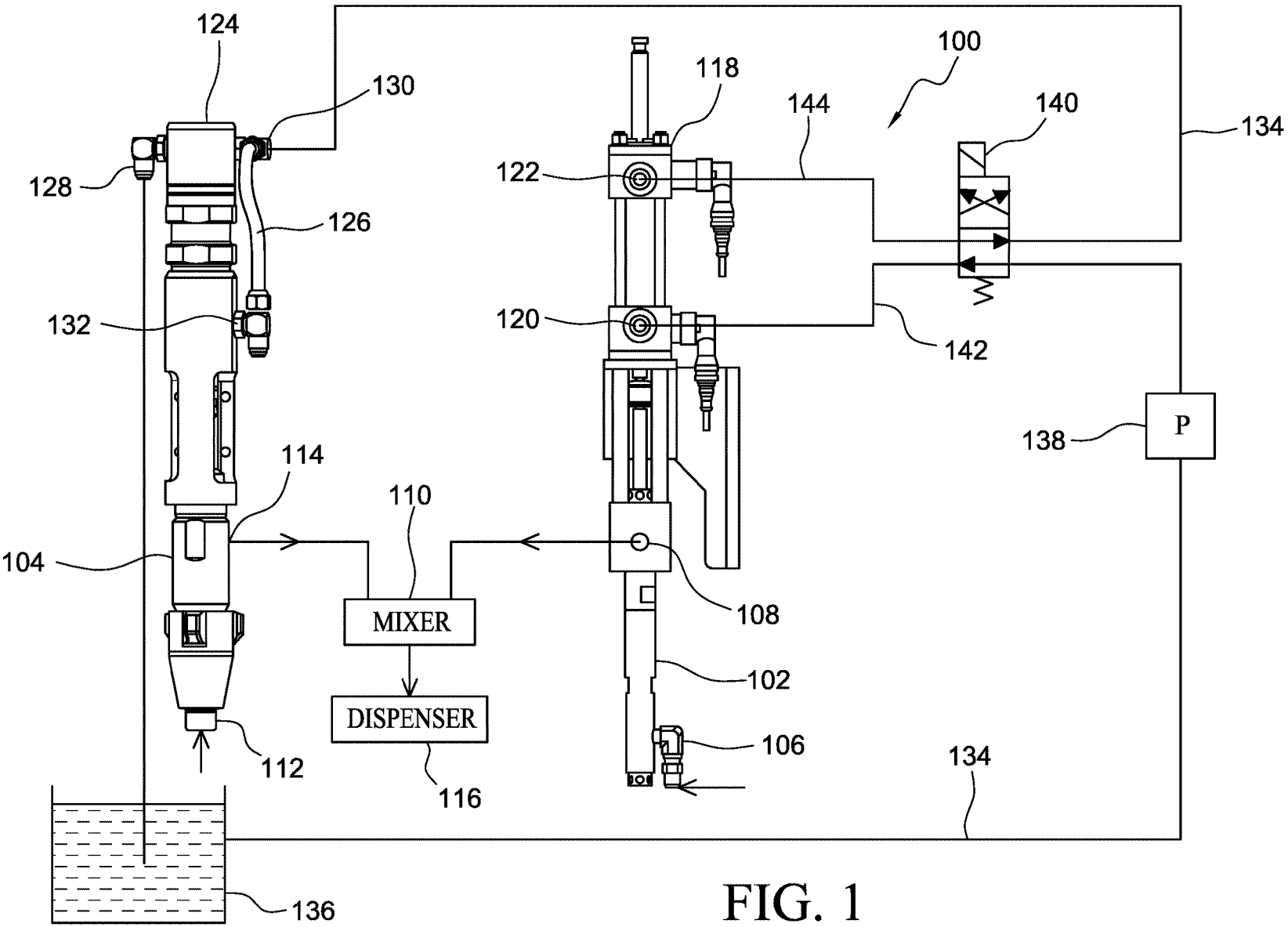
FIG. 1 is a schematic hydraulic circuit diagram showing the new and improved pump system of the present invention wherein a two-position, four-way valve is disposed at a first position at which the incoming hydraulic fluid is conducted to a first lower inlet port of a first hydraulic motor, while a second upper hydraulic fluid outlet port of the first hydraulic motor is fluidically connected to a hydraulic inlet conduit of a second hydraulic motor.

Referring now to the drawings, and more particularly to FIG. 1 thereof, the new and improved pump system is illustrated and is generally indicated by the reference character 100. More particularly, the pump system 100 comprises a first double-acting two-valve pump 102, which may be, for example, a conventional pump, or alternatively, the first double-acting two-valve pump 102 pump may be a pump of the type more fully disclosed within U.S. patent application Ser. No. 15/841,650 which was filed on Dec. 14, 2017, and a second double-acting two-valve pump 104 which may also be, for example, a conventional pump.

For the purposes of this disclosure, the first double-acting two-valve pump 102 will be considered to be the master pump, while the second double-acting two-valve pump 104 will be considered to be the slave pump. The first double-acting two-valve pump 102 is seen to comprise a fluid inlet 106 and a fluid outlet 108, by means of which its fluid, for example, the catalyst, may be pumped out from the first double-acting two-valve pump 102 and toward a mixer 110. In a similar manner, the second double-acting two-valve pump 104 is seen to comprise a fluid inlet 112 and a fluid outlet 114, by means of which its fluid, for example, the resin, may be pumped out from the second double-acting two-valve pump 104 and toward the mixer 110 within which the two components, the catalyst and the resin, will be mixed in accordance with predeterminedly desired proportions such that the end product can then be transmitted to a dispenser 116 which may be any one of a variety of dispensing devices such as a dispensing gun, a spray gun, and the like.

Continuing further, and in accordance with the principles and teachings of the present invention, the first double-acting two-valve pump 102 is provided with a first hydraulic motor 118 which comprises a first lower hydraulic motor inlet port 120 and a first upper hydraulic motor outlet port 122. In a similar manner, the second double-acting two-valve pump 104 is provided with a second hydraulic motor 124 which comprises a second hydraulic motor inlet conduit 126 and a second hydraulic motor outlet port 128. As will become more fully understood in connection with the detailed description of FIG. 3, the second hydraulic motor inlet conduit 126 fluidically connects to first and second vertically spaced second hydraulic motor inlet ports 130, 132. It is additionally apparent from FIG. 1 that the first and second hydraulic motors 118,124 of the pump system 100 are disposed within a closed-circuit or recirculation hydraulic fluid flow path 134 which includes a hydraulic fluid reservoir tank 136, and an auxiliary pump 138 which draws hydraulic fluid from the reservoir tank 136 and provides the same to the first hydraulic motor 118. It is lastly noted that in conjunction with the first and second hydraulic motors 118, 124 and the closed-circuit or recirculation hydraulic fluid flow path 134, there is also provided a two-position, four-way valve 140. While the two-position, four-way valve 140 is illustrated as being located or disposed externally of the first hydraulic motor 118, the two-position, four-way valve 140 can be located or disposed internally of the first hydraulic motor 118, or alternatively still further, the first hydraulic motor 118 may be provided with a different type of two-position valve which will effectively operate in a manner similar to that of the two-position, four-way valve 140. Still yet further, a suitable three-position four-way valve can be utilized.

Having described substantially all of the structural components comprising the new and improved pump system 100, an operational description of the same will now be provided. More particularly, as illustrated within FIG. 1, hydraulic fluid is withdrawn from the hydraulic fluid reservoir tank 136 by means of the auxiliary pump 138 such that the auxiliary pump 138 can supply the hydraulic fluid to the first lower inlet port 120 of the first hydraulic motor 118 by means of a first hydraulic inlet conduit 142. The hydraulic fluid conducted into the first hydraulic motor 118, by means of the first hydraulic inlet conduit 142, will act upon an undersurface portion of a first hydraulic motor piston, not illustrated but disposed internally within the first hydraulic motor 118 and operatively connected to a working piston disposed internally within the first double-acting two-valve pump 102, so as to cause the first hydraulic motor piston, not illustrated, to be elevated toward its upper end-of-stroke position. While the first hydraulic motor piston, not illustrated, is moving toward its upper end-of-stroke position, hydraulic fluid from above the first hydraulic motor piston, not illustrated, will be exhausted from the first upper outlet port 122 of the first hydraulic motor 118 and will flow into a first hydraulic outlet conduit 144. It is to be noted that as a result of the disposition of the two-position, four-way valve 140 at its first position as illustrated within FIG. 1, the fluid flows of the hydraulic fluid from the closed-circuit or recirculation hydraulic fluid flow path 134 to the first hydraulic inlet conduit 142, and from the first hydraulic outlet conduit 144 to the closed-circuit or recirculation hydraulic fluid flow path 134, will effectively be linear as the fluid flows pass through the two-position, four-way valve 140. After the hydraulic fluid again enters the closed-circuit or recirculation hydraulic fluid flow path 134, the hydraulic fluid will flow toward the second hydraulic motor 124, enter the second hydraulic motor inlet conduit 126, eventually be exhausted through means of the second hydraulic motor outlet port 128, and be conducted back to the hydraulic fluid reservoir tank 136 whereby auxiliary pump 138 can again withdraw hydraulic fluid from the hydraulic fluid reservoir tank 136 and output the same toward the first hydraulic motor 118.

Figure 2:
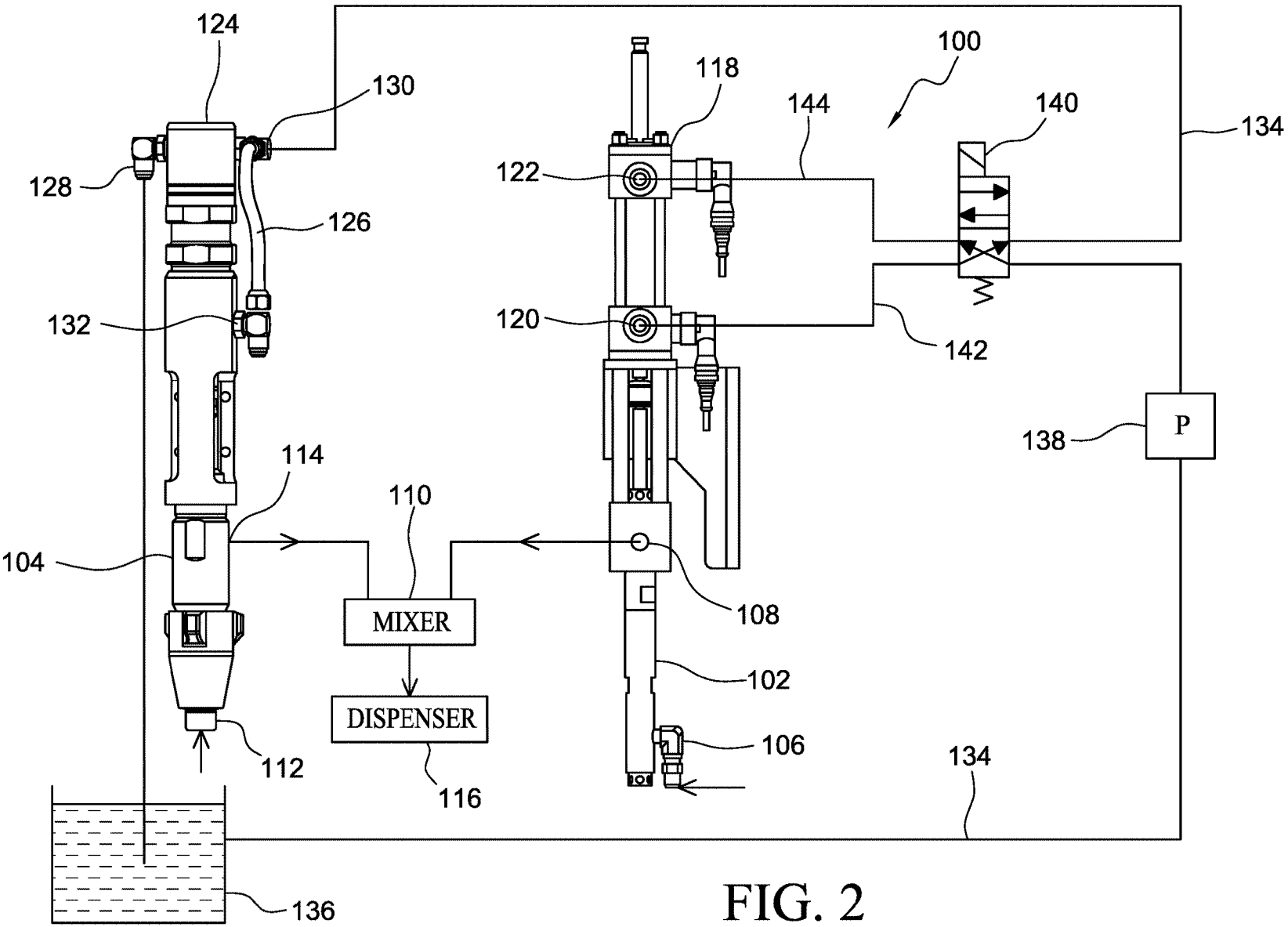
FIG. 2 is a schematic hydraulic circuit diagram, similar to that of FIG. 1 showing, however, the new and improved pump system of the present invention wherein the two-position, four-way valve has been switched to its second position at which the incoming hydraulic fluid is now conducted to the second upper outlet port of the first hydraulic motor, while the first lower hydraulic fluid inlet port of the first hydraulic motor is fluidically connected to the hydraulic inlet conduit of the second hydraulic motor.

It is to be noted that when the first hydraulic motor piston, not illustrated, has reached its upper end-of-stroke position, a signal will be generated so as to cause the two-position, four-way valve 140 to be switched whereby the two-position, four-way valve 140 will now be disposed at the position illustrated within FIG. 2. Accordingly, when the hydraulic fluid from auxiliary pump 138 is conducted toward the first hydraulic motor 118, the incoming hydraulic fluid will actually be conducted through a first cross-path defined within the two-position, four-way valve 140 so as to be conducted into the first hydraulic outlet conduit 144 and into the first hydraulic motor outlet port 120 such that the incoming hydraulic fluid can act upon an upper surface portion of the first hydraulic motor piston, not illustrated, so as to drive the same in the downward direction. At the same time, hydraulic fluid disposed beneath the first hydraulic motor piston, not illustrated, will be exhausted out from the first hydraulic motor inlet port 122, into the first hydraulic inlet conduit 142, and through a second cross-path defined within the two-position, four-way valve 140 so as to be conducted into the closed-circuit or recirculation hydraulic fluid flow path 134 whereby the hydraulic fluid can be conducted toward the second hydraulic motor 124. As was the case with the first hydraulic motor piston, not illustrated, upon reaching its upper end-of-stroke position, when the first hydraulic motor piston, not illustrated, reaches its lower end-of-stroke position, another signal is generated so as to again switch the two-position, four-way valve 140 from its position illustrated within FIG. 2 back to its original position as illustrated within FIG. 1. The entire cyclic operation of the system is then of course continuously repeated as long as the first and second pumps 102,104 are in operation.

Figure 3:
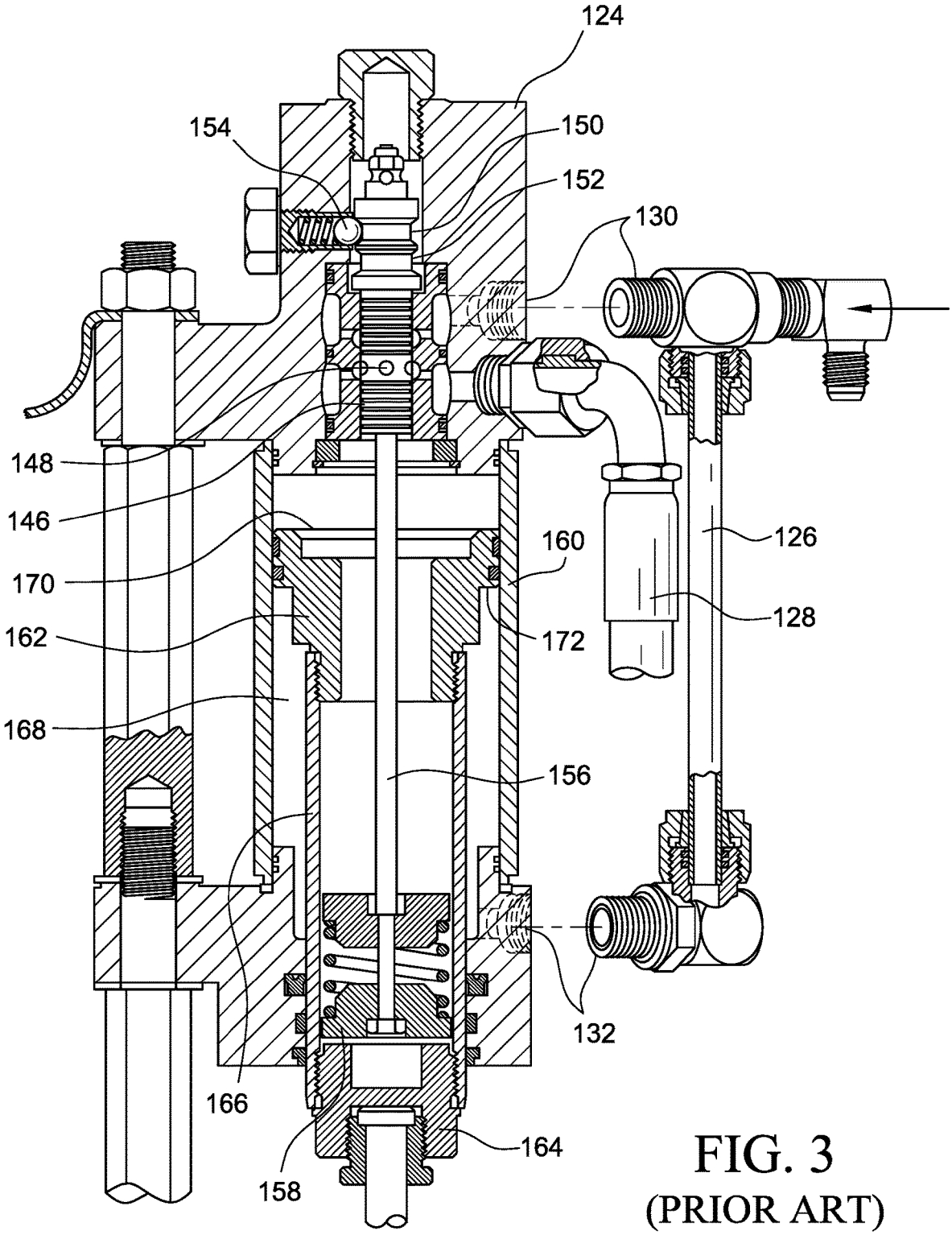
FIG. 3 (PRIOR ART)
FIG. 3 is a cross-sectional view of a conventional PRIOR ART hydraulic motor which may be utilized in conjunction with the resin slave pump as illustrated within FIG. 1.

In order to provide a complete disclosure of the operation of the first and second hydraulic motors 118,124, a brief description of the second conventional hydraulic motor will now be described in connection with FIG. 3. As has been previously noted, the second hydraulic motor is a conventional hydraulic motor that may be utilized in conjunction with the second resin slave pump 104, and it is seen that the second hydraulic motor inlet conduit is disclosed at 126, the first and second vertically spaced upper and lower second hydraulic motor inlet ports are disclosed closed at 130,132, and the second hydraulic motor outlet port is disclosed at 128. Internally of the second hydraulic motor 124, there is disposed a vertically reciprocable hollow tubular spool valve 146 which has a plurality of holes 148 defined in a circumferential array within the side wall portions of the spool valve 146. The upper portion of the spool valve 146 is provided with a pair of vertically spaced circumferentially grooved or notched portions 150,152, and a spring-biased ball detent 154 is adapted to be seated within one of the grooved portions 150,152 so as to effectively maintain the spool valve 146 at its elevated UP position or at its lowered DOWN position. The spool valve 146 is fixedly connected to a vertically oriented axially located rod member 156, the lower end of which is attached to a two-piece, spring biased stop member 158. The second hydraulic motor 124 further comprises an external tubular housing 160 within which a vertically movable piston assembly is disposed. The piston assembly comprises a vertically movable piston 162 which is fixedly attached to a lower cap member 164 of the working piston of the second double-acting two-valve pump 104 by means of an annular connective wall member 166. In this manner, the piston assembly of the second hydraulic motor 124, comprising the piston 162, the annular connective wall member 166, and the lower cap member 164 are movable relative to the spool valve 146 and its connective rod member 156. It is also seen that the second hydraulic motor inlet port 132 is fluidically connected to an internal annular chamber 168 which is defined between the external housing 160 of the second hydraulic motor 124 and the internally disposed annular connective wall member 166 of the piston assembly.

Accordingly, in operation, and as an exemplary starting point, the spool valve 146 will be initially disposed at its elevated UP position, as maintained by means of the detent ball 154 effectively being latched or held within the lower one 152 of the two vertically spaced circumferentially grooved or notched portions 150,152 at which position the plurality of holes or apertures 148 defined therein will be disposed opposite to, or in alignment with, the first hydraulic motor inlet port 130 of the first hydraulic motor inlet conduit 126. It is also to be remembered, however, that hydraulic fluid will also flow downwardly through the first hydraulic inlet conduit 126 so as to likewise enter the internal portion of the second hydraulic motor 124 through means of the second lower hydraulic motor inlet port 132. Therefore, incoming hydraulic fluid is permitted to enter the spool valve 146 from the first upper hydraulic motor inlet port 130, flow downwardly through the spool valve 146, and act upon the upper surface portion 170 of the second hydraulic motor piston 162, while the incoming hydraulic fluid, entering the second lower hydraulic motor inlet port 132, likewise acts upon the undersurface portion 172 of the second hydraulic motor piston 162. In view of the fact, however, that the hydraulic fluid from the first upper hydraulic motor inlet port 130 acts upon a much larger surface area, comprising the upper surface portion 170 of the second hydraulic motor piston 162, as compared to the hydraulic fluid from the second lower hydraulic motor inlet port 132 acting upon a relatively much smaller undersurface portion 172 of the second hydraulic motor piston 162, the hydraulic fluid therefore causes the second hydraulic motor piston 162 to move downwardly within the external housing 160 of the second hydraulic motor 124 and relative to the spool valve connective rod member 156 until the second hydraulic motor piston 162 encounters the spring-biased stop member 158. Any hydraulic fluid disposed beneath the second hydraulic motor piston 162 will effectively be forced back outwardly through the second lower hydraulic motor inlet port 132 so as to effectively be entrained with the hydraulic fluid entering the second hydraulic motor 124 through means of the first upper hydraulic motor inlet port 130.

At this time, as a result of the engagement of the second hydraulic motor piston 162 with the spring-biased stop member 158, the second hydraulic motor piston 162 will cause the spring-biased stop member 158 to move downwardly within the annular connective wall member 166 of the piston assembly thereby, in turn, causing the spool valve connective rod member 156 to move downwardly which effectively pulls the spool valve 146 downwardly. As a result of these forces, the spring-biased detent ball 154 is momentarily forced out from the lower circumferentially grooved or notched portion 152 and is subsequently seated within the upper circumferentially grooved or notched portion 150 as illustrated in FIG. 3. Accordingly, the flow of hydraulic fluid into the second hydraulic motor 124 by means of the first upper hydraulic motor inlet port 130 is effectively blocked by means of a solid portion of the spool valve 146, and so the hydraulic fluid can now only enter the second hydraulic motor 124 through means of the second lower hydraulic motor inlet port 132. Such incoming hydraulic fluid now acts upon the undersurface portion 172 of the second hydraulic motor piston 162, forcing the same to move upwardly, and as a result of the upward movement of the second hydraulic motor piston 162, hydraulic fluid disposed above the second hydraulic motor piston 162 will now be exhausted from the second hydraulic motor 124 through means of the spool valve 146, its plurality of holes or apertures 148, which are now disposed opposite to, or aligned with, the second hydraulic motor outlet port 128, and out through the second hydraulic motor outlet port 128 whereby the hydraulic fluid can flow toward the hydraulic fluid reservoir tank 136 such that the entire hydraulic fluid control and operation of the first and second hydraulic motors 118,124 can be cyclically repeated. It is to be lastly noted that when the second hydraulic motor piston 162 approaches its upward end-of-stroke movement, as illustrated within FIG. 3, the lower cap member 164 of the piston assembly will encounter the spring-biased stop member 158 causing it to move upwardly thereby, in turn, causing the spool valve connective rod member 156 and the spool valve 146 to move upwardly whereby the spool valve 146 will be returned to its original UP position at which time, once again, the detent latching ball 154 will be disposed within the lower circumferentially grooved or notched portion 152 and the apertures or holes 148, defined within the spool valve 146, will again be disposed opposite to, or aligned with, the first upper hydraulic motor inlet port 130. In this disposition, the hydraulic motor outlet port 128 will be blocked so that hydraulic fluid cannot be exhausted to the hydraulic fluid reservoir tank 136.

Thus, it may be seen that in accordance with the principles and teachings of the present invention, there has been provided a pump system wherein a first hydraulic motor, operatively associated with a first fluid pump for pumping a first fluid component, drives a second hydraulic motor, operatively associated with a second fluid pump for pumping a second fluid component, in a hydraulically synchronized manner. Obviously, many variations and modifications of the present invention are possible in light of the above teachings. It is therefore to be understood that within the scope of the appended claims, the present invention may be practiced otherwise than as specifically described herein.

REFERENCE NUMBER KEY

100—Pump system
102—First double-acting two-valve pump
104—Second double-acting two-valve pump
106—Fluid inlet of pump 102 for first material to be pumped
108—Fluid outlet of pump 102 for first material to be pumped
110—Mixer
112—Fluid inlet of pump 104 for second material to be pumped
114—Fluid outlet of pump 104 for second material to be pumped
116—Dispenser for dispensing composite fluid supplied from mixer 110
118—First hydraulic motor operatively connected to first pump 102
120—Hydraulic fluid inlet of first hydraulic motor 118
122—Hydraulic fluid outlet of first hydraulic motor 118
124—Second hydraulic motor operatively connected to second pump 104
126—Hydraulic fluid inlet conduit for second hydraulic motor 124
128—Hydraulic fluid outlet port of second hydraulic motor 124
130—First upper hydraulic fluid inlet port for second hydraulic motor 124
132—Second lower hydraulic fluid inlet port for second hydraulic motor 124
134—Closed circuit hydraulic fluid flow path
136—Hydraulic fluid reservoir tank
138—Auxiliary pump
140—Two-position four-way valve
142—First hydraulic inlet conduit
144—Second hydraulic outlet conduit
146—Spool valve of second hydraulic motor 124
148—Apertures or holes within spool valve 146
150—First upper circumferentially grooved or notched portion of spool valve 146

152—Second lower circumferentially grooved or notched portion of spool valve 146
154—Spring-biased detent ball
156—Vertically oriented connective rod operatively connected to spool valve 146
158—Spring-biased stop member operatively connected to rod 156
160—External housing of second hydraulic motor 124
162—Internal piston of second hydraulic motor 124
164—Lower end cap of piston assembly of second hydraulic motor 124
166—Connective tubular member of piston assembly
168—Annular chamber defined between external housing 160 and member 166
170—Upper surface portion of piston 162
172—Undersurface portion of piston 162

What is claimed as new and desired to be protected by Letters Patent of the United States of America, is:

1. A pump system, comprising:

a first pump for pumping a first component of a mixture, supplied to an inlet of said first pump, out from an outlet of said first pump so as to be dispensed toward a mixer;

a second pump for pumping a second component of the mixture, supplied to an inlet of said second pump, out from an outlet of said second pump so as to be dispensed toward said mixer;

a first hydraulic motor operatively connected to said first pump;

a second hydraulic motor operatively connected to said second pump;

a hydraulic fluid reservoir tank containing hydraulic fluid, separate and distinct from the first and second components of the mixture being respectively pumped out from said first and second pumps;

a first two-position valve interposed between said first hydraulic motor and said second hydraulic motor for controlling hydraulic fluid flow into and out from opposite ends of said first hydraulic motor and between said first hydraulic motor and said second hydraulic motor when said first two-position valve is at first and second positions;

a pump, interposed between said hydraulic fluid reservoir tank and said first two-position valve, for withdrawing the hydraulic fluid from said hydraulic fluid reservoir tank and for pumping the hydraulic fluid toward said first two-position valve; and a second two-position valve operatively associated with said second hydraulic motor and said second pump for controlling the hydraulic fluid flow into and out from opposite ends of said second hydraulic motor as received from said first hydraulic motor so as to permit said second hydraulic motor to operate said second pump when said second two-position valve is disposed at a first position, and to permit the hydraulic fluid to be conducted out to said hydraulic fluid reservoir tank when said second two-position valve is disposed at a second position;

wherein a closed circuit hydraulic fluid flow path is defined as a result of the hydraulic fluid being withdrawn from said hydraulic fluid reservoir tank by said pump, said hydraulic fluid being pumped by said pump toward said first hydraulic motor, said first hydraulic motor driving said second hydraulic motor as a result of the hydraulic fluid being conducted from said first hydraulic motor to said second hydraulic motor when said first, two-position valve is disposed at either one of said first and second positions, and said second hydraulic motor outputting the hydraulic fluid back toward said hydraulic fluid reservoir tank when said second two-position valve is disposed at said second position, whereby continuous operation of said first and second hydraulic motors permits continuous operation of said first and second pumps for pumping the first and second components of the mixture to be dispensed.

2. The pump system as set forth in claim 1, wherein said pump withdraws the hydraulic fluid from said hydraulic fluid reservoir tank and supplies the hydraulic fluid to said first hydraulic motor, operatively connected to said first pump, through said first two-position valve.

3. The pump system as set forth in claim 1, wherein:

a hydraulic fluid outlet of said first hydraulic motor is fluidically connected to a hydraulic fluid inlet of said second hydraulic motor whereby said first hydraulic motor, operatively connected to said first pump, drives said second hydraulic motor operatively connected to said second pump.

4. The pump system as set forth in claim 1, wherein:

said first two-position valve comprises a two-position four-way valve fluidically connected to said closed-circuit hydraulic fluid flow path such that during a first operative cycle of said first hydraulic motor, the hydraulic fluid passes through said two-position, four-way valve and enters a hydraulic fluid inlet of said first hydraulic motor while the hydraulic fluid is exhausted from a hydraulic fluid outlet of said first hydraulic motor so as to be conducted toward said second hydraulic motor, whereas during a second operative cycle of said first hydraulic motor, the hydraulic fluid passes through said two-position, four-way valve and enters said hydraulic fluid outlet of said first hydraulic motor while the hydraulic fluid is exhausted from said hydraulic fluid inlet of said first hydraulic motor so as to be conducted toward said second hydraulic motor.

5. The pump system as set forth in claim 1, wherein:

said first pump comprises a master pump; and said second pump comprises a slave pump.

6. The pump system as set forth in claim 1, wherein:

said first pump comprises a catalyst pump for pumping a catalyst component of the mixture; and said second pump comprises a resin pump for pumping a resin component of the mixture.

* * * * *